United States Patent [19]

Weiss et al.

[11] Patent Number: 4,523,598

[45] Date of Patent: Jun. 18, 1985

[54] PROCESS FOR IMPROVING THE FILLING CAPACITY OF TOBACCO MATERIAL

[75] Inventors: Arno Weiss, Delingsdorf; Jörn Ulrich, Bönningstedt, both of Fed. Rep. of Germany

[73] Assignee: B.A.T. Cigarettenfabriken GmbH, Fed. Rep. of Germany

[21] Appl. No.: 413,753

[22] Filed: Sep. 1, 1982

[30] Foreign Application Priority Data

Sep. 5, 1981 [DE] Fed. Rep. of Germany ..... 3135283
Dec. 3, 1981 [DE] Fed. Rep. of Germany ..... 3147846

[51] Int. Cl.[3] ..... A24B 3/18

[52] U.S. Cl. ..... 131/291; 131/296; 131/300; 131/304

[58] Field of Search ..... 131/241, 246, 290, 300, 131/304

[56] References Cited

U.S. PATENT DOCUMENTS 4,040,431 8/1977 Ashworth et al. ..... 131/296
4,044,780 8/1977 Kelly ..... 131/296

FOREIGN PATENT DOCUMENTS 2637124 9/1975 Fed. Rep. of Germany ..... 131/296

*Primary Examiner*—V. Millin
*Attorney, Agent, or Firm*—Arnold, White & Durkee

[57] ABSTRACT

Increases in filling capacity of 30 to 100% are achieved when tobacco material with a moisture content of 18 to 80% by weight and a temperature of −80° to 100° C. is accelerated to a velocity of at least 20 meters per second by means of a gaseous medium, is subsequently decelerated and is dried in a conventional way. The tobacco material can be accelerated, together with the gaseous medium, in a nozzle of the Venturi type or can be introduced into the fast-flowing gaseous medium.

24 Claims, 5 Drawing Figures

PROCESS FOR IMPROVING THE FILLING CAPACITY OF TOBACCO MATERIAL

BACKGROUND OF THE INVENTION

The invention relates to a process for improving the filling capacity of tobacco material by expanding moist tobacco material by means of pressure reduction and subsequent drying to the processing moisture content.

Numerous processes for expanding tobacco material are known. In these processes, cut tobacco ribs or tobacco leaf material is subjected, while moist, to a more or less intense increase in temperature or reduction in pressure. The rapid evaporation of the liquid contained in the tobacco, for example water or organic solvents, leads to a greater or lesser expansion of the tobacco cell structure. The disadvantage of these processes is that the expansion ratio is to a certain extent unsatisfactory and that the expanded structure is at least partially lost again during subsequent processing.

The arrangement of a Venturi nozzle at the end of a drying stage for tobacco material is known from German Offenlegungsschrift No. 2,637,124 (see FIG. 4).

Tobacco expansion cannot occur here, as the Venturi nozzle is located at a point in the apparatus where the tobacco has already been dried. Tobacco dried in this manner no longer has the elasticity necessary for expansion. In contrast to this, in the process of the invention, the tobacco passes through the expansion stage in the moist state and is dried only subsequently.

The present invention is directed to a process of the type mentioned in the introduction, but in which tobacco material in the moist state is subjected, within an extremely short period of time, to pressure reduction and at the same time to a sharp increase in temperature. The resulting abrupt evaporation of the liquid contained in the tobacco material leads to an improvement in the filling capacity of the tobacco material of 30 to 100%, without the tobacco cell structure being destroyed to any notable extent. In spite of the high expansion result, the structure is preserved even during further processing of the tobacco material.

SUMMARY OF THE INVENTION

The instant invention is a process for improving the filling capacity of tobacco. Moist tobacco material is expanded by accelerating the tobacco material to a velocity of at least 20 meters per second, subsequently decelerating the tobacco material and finally drying the tobacco material.

DETAILED DESCRIPTION

Figures 1, 2:
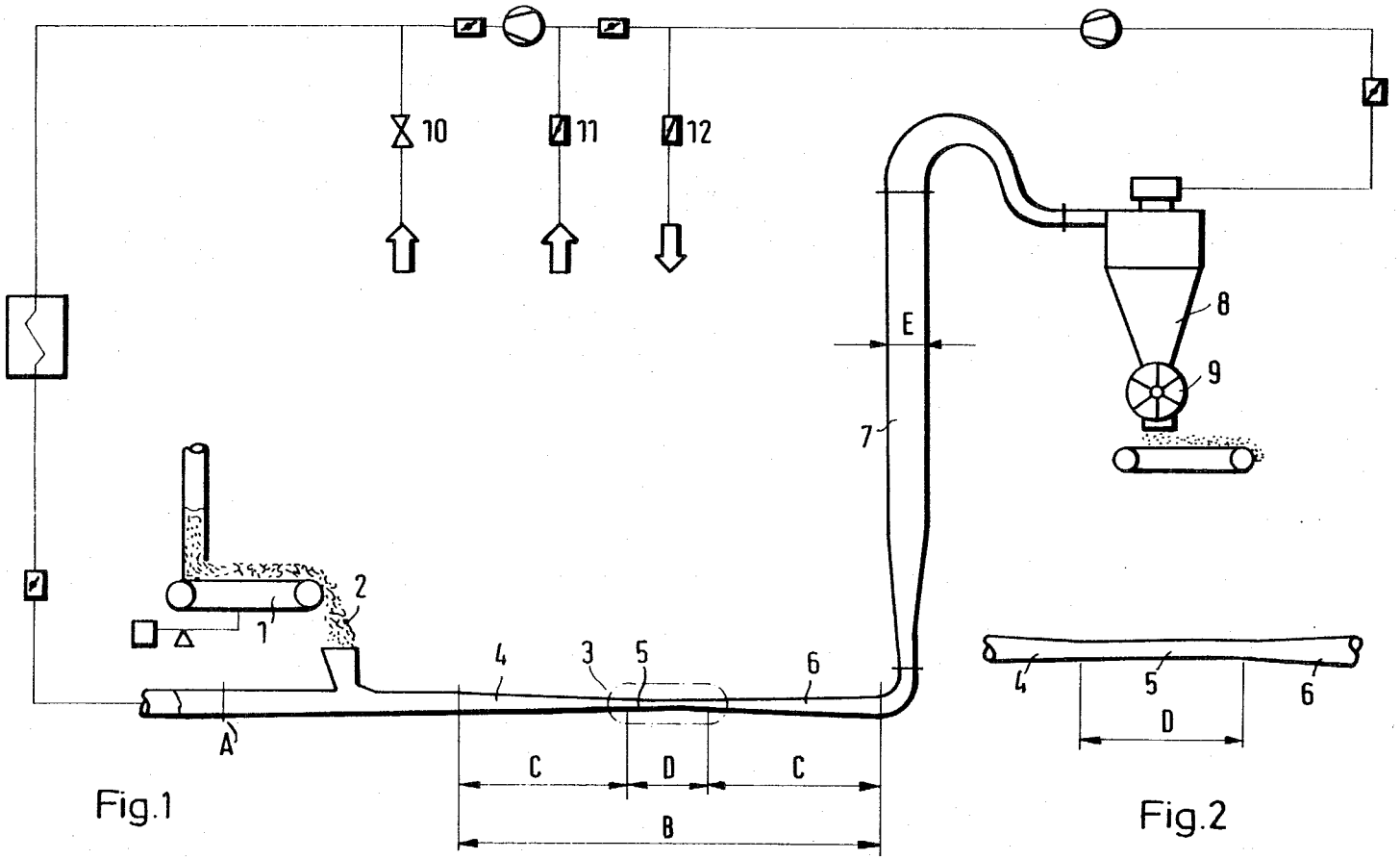
FIG. 1 shows a flow diagram for a preferred form of the process.
FIG. 2 shows, in a diagrammatic representation, a nozzle arrangement for use in the process according to FIG. 1.

The desired expansion of the tobacco material is achieved, according to the present invention, when tobacco material having a moisture content of about 18 to about 80% and a temperature of −80° to 100° C. is: (1) accelerated to a velocity of at least 20 meters per second by means of a gaseous medium; (2) subsequently decelerated; and, (3) dried in a conventional manner. The preferred moisture content of the tobacco material to be treated is between about 30% and about 80%. (All moisture contents throughout the description and claims are on a wet basis.) Within the meaning of the invention, tobacco material refers especially to cut rib and/or leaf material and also reconstituted tobacco.

The process of the invention offers, in particular, the advantage that the expansion system can be of simple construction in terms of equipment. The energy requirement is small in view of the low mass ratio of conveying gas to tobacco material. Furthermore, expansion of the tobacco can take place in a continuous operation by means of the process of the invention.

Following the expansion, the tobacco material is dried to the processing moisture content in a conventional way. Normally, drying takes place to a moisture content of 10 to about 16%. However, it is also possible to dry the tobacco material to a considerably lower moisture content, for example to 2%. An especially stable fixing of the expanded structure is achieved as a result of drying to this level. However, it is necessary for such highly dried tobacco material thus obtained to be moistened to a moisture content of 10 to 16% before further processing.

Air, steam, air/steam mixtures with a steam content of 2 to 80% by weight, inert gases, such as nitrogen or carbon dioxide, and hydrocarbons or mixtures thereof can be used as the gaseous medium. Suitable hydrocarbons include volatile hydrocarbons and halogenated hydrocarbons with boiling temperatures between -4° and 80° C. (e.g. see U.S. Pat. Nos. 3,524,451 and 3,575,178). Steam, which can also be superheated depending on the particular process used, is preferred.

According to a preferred embodiment of the invention, the tobacco material is introduced into a free jet formed by the gaseous medium and having a flow velocity of at least 20 meters per second. The tobacco material is either sucked in by the free jet itself or introduced at essentially the narrowest point of a suitable nozzle, for example, of an ejector-type or similar type. The free jet can also be limited by a fixed wall. As a result of the suction effect of the generally turbulent free jet or of the nozzle, the tobacco material is drawn into the core of the free jet or of the nozzle and is accelerated to the flow velocity of the gaseous medium. The lower pressure prevailing in the core of the free jet or of the nozzle causes expansion of the tobacco material simultaneously with heat exchange and mass transfer. As the diameter of the free jet or of the nozzle increases, the flow velocity of the gaseous medium, and correspondingly the velocity of the tobacco material diminishes. If the free jet or nozzle is arranged horizontally, the gaseous medium and the tobacco material are separated as the velocity decreases. The tobacco material is subsequently dried in a conventional way. The expansion apparatus can also be connected to a dryer to form a single unit.

The above-mentioned flow velocity of the gaseous medium of at least 20 meters per second refers essentially to the jet base; the flow velocity is preferably at least 80 meters per second.

Whereas mention has been made, up to now, of those process variants of the invention in which the tobacco material is introduced into the gaseous medium already having a flow velocity of at least 20 meters per second and is thus accelerated to the flow velocity of the medium, it is also possible to accelerate the tobacco material, especially cut tobacco ribs, together with the gaseous medium. Preferably, the tobacco material together with the gaseous medium is first brought to a velocity of 6 to 50 meters per second; the gaseous medium and tobacco material is then accelerated to a velocity of at least 50 meters per second within at most 1/10 of a second in an acceleration zone of an expansion reactor and next conveyed through a zone of constant velocity and subsequently decelerated in a deceleration zone of the expansion reactor. The residence time of the tobacco material in the zone of constant velocity is between about 1/100 and about 1/1000 of a second. In this case, the ratio of the velocity of the gaseous medium and of the tobacco material before the acceleration zone to the maximum velocity in the latter is at least 1:3, and preferably at least 1:6. The acceleration of the gaseous medium and of the tobacco material takes place preferably in a nozzle of the Venturi type or another suitable nozzle arrangement located in the expansion reactor.

In general, it is true of all the process variants that the expansion result achieved is better, the higher the velocity and temperature of the gaseous medium.

According to a further advantageous embodiment of the invention, the gaseous medium has a temperature of 50° to 1000° C. and preferably at least 100° C. Since, in general, the temperature of the gaseous medium is above that of the tobacco material, a certain amount of heat exchange takes place. Because of the relatively short time in which the tobacco material and the conveying gas come in contact any drying taking palace is negligible.

The process of the invention is explained in more detail below with reference to the drawings and to exemplary embodiments.

In FIG. 1, an apparatus for carrying out the process of the invention comprising a conveyor device 1 for introducing cut tobacco ribs 2 into the feed part of a (horizontally or vertically arranged) expansion reactor 3 is shown. The expansion reactor comprises an inserted nozzle of the Venturi type or other suitable nozzle arrangement with an acceleration zone 4, a zone 5 of constant velocity and a deceleration zone 6. A conventional flow dryer 7 with a connected separator 8 adjoins the expansion reactor. The system can be self-contained; it is sealed off from the surroundings on the feed side by a cellular-wheel valve (not shown) and on the discharge side by a cellular-wheel valve 9 by means of which the expanded tobacco is removed from the system.

The conveying gas is supplied via valves or flaps 10 and 11, for example saturated steam at 10 and fresh air at 11; the waste gas is removed via a flap 12. The nozzle arrangement (4, 5, 6) is also evident from FIG. 2 in an enlarged representation.

The following general process parameters apply to the process carried out in the embodiment shown in FIG. 1. Tobacco material with a moisture content of 18 to 80%, preferably 40 to 80%, is conveyed at temperatures between about −80° C. and about 100° C. through the expansion nozzle together with a stream of hot gas. The stream of hot gas has a temperature of between about 50° and about 1000° C. The steam content of the hot gas can vary between 0 and 100% by weight. The velocity of the stream of hot gas before the acceleration zone is between about 6 and about 50 meters per second. In the narrowest nozzle cross-section, the velocity increases to at least 50 meters per second. The mass flow of hot gas is about 5 to about 36 times as great as the mass flow of tobacco. The sudden pressure drop in the nozzle leads to flash evaporation of liquid out of the individual fibers. The energy for evaporation of water is obtained essentially from the tobacco fibers themselves. The temperature of the tobacco material drops only slightly in the expansion nozzle. The expansion process lasts for less than 0.1 second, preferably 1/100 to 1/1000 of a second.

Figure 4:
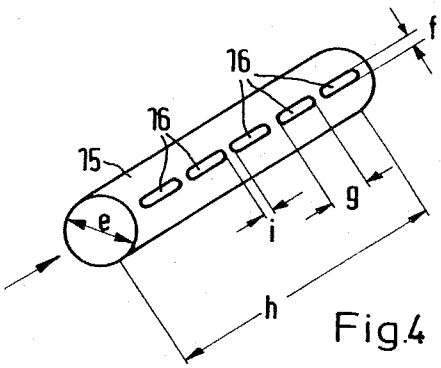
FIG. 4 shows an expansion section for use in the process according to FIG. 3.
Figure 3:
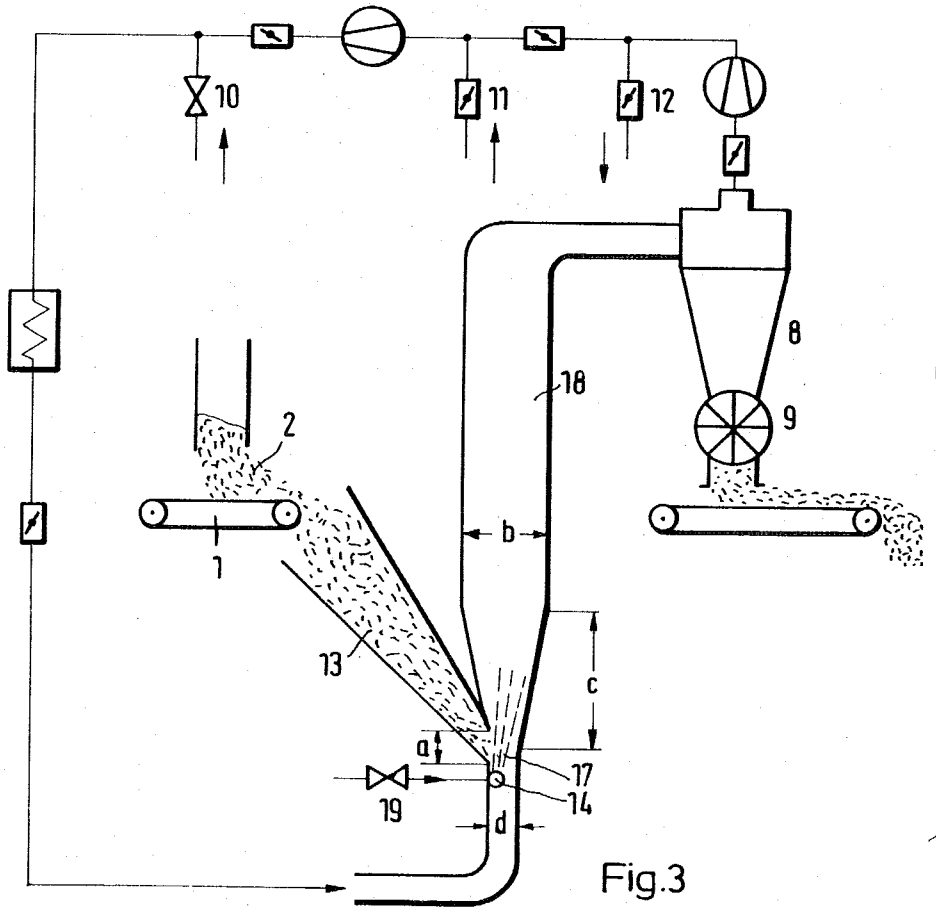
FIG. 3 shows a flow diagram for another embodiment of the process of the invention.

An alternative apparatus for carrying out the process of the invention is shown in FIG. 3 comprising in addition to the conveyor device 1 for the tobacco material 2, a feed part 13 of a horizontally arranged expansion section 14 which consists, as shown in FIG. 4, of a tube 15 having longitudinal slits 16. The longitudinal slits form the base points for a free jet 17. In the embodiment illustrated here, the expansion device 15 is integrated into the inlet of a conventional flow dryer 18, so that the free jet 17 conveys the tobacco material 2 directly into the flow dryer 18. Baffle plates provided to improve the flow guidance are not shown. The tobacco material is drawn off from the flow dryer via the separator 8 and the cellular-wheel valve 9.

The system can be self-contained, being sealed off from the surroundings on the feed side by a cellular-wheel valve (not shown) and on the discharge side by the cellular-wheel valve 9 by means of which the expanded material is removed from the system.

The gaseous medium is supplied via a valve 19; the valve 10 and the flaps 11 and 12 serve for adjusting the dryer.

Figure 5:
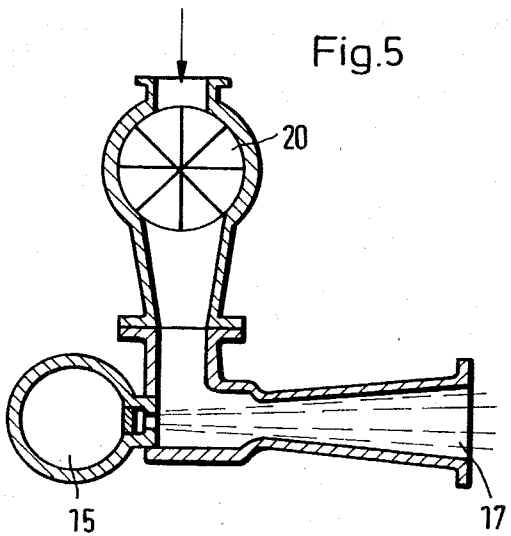
FIG. 5 shows an expansion section working independently of the dryer.

FIG. 5 illustrates an expansion device separate from the drying apparatus. The tobacco material entering the system via a cellular-wheel valve 20 meets the jet 17 essentially perpendicularly, is accelerated and expanded by the latter and is conveyed away essentially horizontally to a dryer device of any design (not shown). Excess pressure or a vacuum can prevail in the system depending on the design of the expansion device.

The following general process paramaters apply to the process of the invention according to FIG. 3. Tobacco material with a moisture content of 18 to 80%, preferably 30 to 80%, is conveyed at temperatures of between -80° and 100° C. into the base point of the free jet or of a nozzle, is accelerated by the gaseous medium and is subsequently decelerated and fed to a dryer. The propellant gas has temperatures of between about 50° and about 1000° C. The steam content of the gas can be between 0 and 100% by weight. The velocity of the propellant gas in the narrowest cross-section of the nozzle or at the base point of the free jet is at least 20 meters per second. An upper limit of the flow velocity is limited solely by practical reasons, and can be, for example, up to 900 meters per second. The sudden pressure drop in the free jet or in the nozzle, with the supply of heat superimposed on it, leads to flash evaporation from the individual fibers. The expansion process lasts for less than 0.5 second, preferably for 1/10 to 1/1000 of a second.

The invention is explained, in more detail, in the examples below.

EXAMPLE 1

A pilot plant on a semi-technical scale was used for investigating the process of the invention according to FIG. 1. The dimensions of the pilot plant are as follows:

| | |
|---|---|
| Maximum edge length of the expansion reactor (at A): | 150 mm |
| Total length of the expansion reactor (B): | 2500 mm |
| Total length of the acceleration zone and deceleration zone (C): | 1000 mm each |
| Edge length of the expansion reactor at the start of the acceleration zone and at the end of the deceleration zone: | 100 mm in each case |
| Total length of the zone of constant velocity (D): | 500 mm |
| Edge length of the zone of constant velocity: | 40 mm |
| Total length of the flow dryer: | 3585 mm |
| Diameter of the flow dryer at (E): | 245 mm |

For conducting the test, the pilot plant was adjusted so that the cut ribs could be introduced without a valve. The cut ribs to be treated were moistened with cold water to approximately 45% and conveyed at ambient temperature (25° C.) into the intake. The mass flow of cut ribs was 25 kg per hour and the mass flow of conveying gas was 300 kg per hour. The ratio of the mass flow of conveying gas to the mass flow of cut ribs was therefore 12:1. The temperature of the stream of conveying gas at the cut-rib intake was 340° C.

A mass flow of conveying gas with a steam content of 85% by weight was established. In the cross-section immediately behind the tobacco inflow a velocity of 22 meters per second was measured and in the narrowest cross-section of the expansion nozzle a velocity of 137.5 meters per second was measured. After the expansion nozzle the cut ribs were dried to 13% in the otherwise conventional drying stage. Discharge via a valve was effected by means of a cyclone. The expanded cut ribs and cut ribs treated only in a flow dryer for purposes of comparison were conditioned for 72 hours at a relative atmospheric humidity of 60% and at 22° C. (according to Deutsche Industrinorm [DIN] 10244). The filling force was measured in a Borgwaldt densimeter (quantity taken 10 g, diameter of the measuring cup 60 mm, load 3000 g and 30 seconds).

The residual height of the cut ribs treated according to the state of the art was 14.8 mm; the residual height the cut ribs obtained according to the process of the invention was 23.7 mm. Both samples had a moisture content of 12.6%; determined by oven drying for 3 hours at 80° C.

The increase in filling capacity of the cut tobacco ribs treated according to the process of the invention is approximately 60% by this measuring method in comparison with the reference product.

EXAMPLE 2

The test according to Example 1 was repeated with cut leaves (20% moisture content). Because of the lower initial moisture content, the mass flow of tobacco was increased to 80 kg per hour and the dryer temperature lowered to 250° C. An increase in filling capacity of 30% was obtained.

EXAMPLE 3

The test according to Example 1 was repeated in the pilot plant described there, the steam content of the mass flow of conveying gas being reduced to 4% by weight. The cut ribs to be treated were moistened with cold water to approximately 45% and conveyed into the intake at ambient temperature (25° C.). The mass flow of cut ribs was 25 kg per hour; the mass flow of the conveying gas was 300 kg per hour. This gives a ratio of the mass flow of conveying gas to the mass flow of cut ribs of 12:1. The temperature of the mass flow of conveying gas at the cut-rib intake was 340° C.

Because of the change in density, a velocity of 15 meters per second is obtained immediately behind the tobacco inflow and a velocity of 93.8 meters per second in the narrowest cross-section of the expansion nozzle. After the expansion nozzle the cut ribs were dried to 13% in a standard drying stage. Discharge via a valve was effected by means of a cyclone. Conditioning and measurement were carried out analogously to Example 1. According to the measuring method used, the increase in filling capacity for the cut tobacco ribs treated according to the invention was 30%.

EXAMPLE 4

A semi-industrial plant was used for investigating the process of the invention according to FIG. 3. The dimensions of the plant are as follows:

| | |
|---|---|
| Depth of the dryer (entire length): | 300 mm |
| Height of the intake (a): | 130 mm |
| Width of the drying stage (b): | 230 mm |
| Length of the widened portion (c): | 600 mm |
| Width before the widened portion (d): | 100 mm |
| Total length of the flow dryer: | 8000 mm |
| Dimensions of the tube: | |
| Diameter of the tube (e): | 18 mm |
| Length of the tube (h): | 300 mm |
| Length of the slits (g): | 50 mm |
| Width of the slits (f): | 5 mm |
| Distance between the slits (i): | 5 mm |
| Number of slits: | 5 |

The tests indicated here were carried out with cut ribs. For conducting the test, the pilot plant mentioned was adjusted so that the cut ribs could be introduced without a valve. The cut ribs to be treated were moistened with cold water to approximately 45% and conveyed into the intake at ambient temperature (20° C.). The mass flow of cut ribs was 100 kg per hour. Saturated steam of 8 bars (t=170.41° C.) was used as propellant gas. The flow of propellant steam was 300 kg per hour. The ratio of the mass flow of cut ribs to the mass flow of propellant steam was therefore 1:3. After the free jet the cut ribs were dried to 15% with air at a temperature of 340° C. in an otherwise conventonal drying stage. Discharge via a valve was effected by a cyclone. The expanded cut ribs and cut ribs treated in a flow dryer (without a free jet) for purposes of comparison were conditioned for 72 hours at a relative atmospheric humidity of 60% and at 22° C. (according to DIN 10244). The filling force was measured in a Borgwaldt densimeter (quantity taken 10 g, diameter of the measuring cup 60 mm, load 3000 g and 30 seconds).

The residual height of the cut ribs treated according to the state of the art was 14.8 mm and that of the cut ribs obtained according to the process of the invention was 18.59 mm. Both samples had a moisture content of 12.6%, determined by oven drying for 3 hours at 80° C. The increase in filling capacity of the cut tobacco ribs treated according to the process of the invention is approximately 25% by this method in comparison with the reference product.

EXAMPLE 5

The test according to Example 4 was repeated in the pilot plant described there, the mass flow of propellant steam being reduced to 80 kg per hour and being superheated to 300° C. (it was not possible to use a larger mass flow of propellant steam because of the steam superheater available). The cut ribs to be treated were moistened with cold water to approximately 45% and conveyed into the base point of the free jet at ambient temperature (25° C.). The mass flow of cut ribs was 100 kg per hour. The ratio of cut ribs to the mass flow of propellant steam is therefore 1:0.8. After the free jet, the cut ribs were dried to 15% at a temperature of 340° C. in the drying stage. Discharge via a valve was effected by means of a cyclone. Conditioning and measurement were carried out analagously to Example 3. According to the measuring method used, the increase in filling capacity for the cut tobacco ribs treated according to the invention is 30%.

What is claimed is:

1. A process for improving the filling capacity of tobacco material by expanding the moist tobacco material in an acceleration zone comprising: introducing said moist tobacco material into a gaseous medium; accelerating said moist tobacco material to a velocity of at least 20 meters per second by means of said gaseous medium, said acceleration reducing the ambient pressure causing said moist tobacco material to expand while in the acceleration zone; decelerating said tobacco material; and drying said tobacco material.

2. The process of claim 1 wherein said tobacco material is introduced into a free jet formed by said gaseous medium.

3. The process of claim 2 wherein said tobacco material is sucked in by the free jet.

4. The process of claim 1 wherein said tobacco material is introduced at the narrowest point of an ejector-type nozzle.

5. The process of claim 1 wherein said tobacco material and said gaseous medium are accelerated in a nozzle of the Venturi type.

6. The process of claim 1 wherein said gaseous material has a temperature of about 50° to about 1000° C.

7. The process of claim 6 wherein said gaseous material has a temperature of at least 100° C.

8. The process of claim 1 wherein said gaseous medium is chosen from the group consisting of air, steam, inert gas, hydrocarbons, or a mixture thereof.

9. A process for improving the filling capacity of tobacco material by expanding the moist tobacco material in an acceleration zone comprising: introducing said moist tobacco material having a moisture content of about 18 to about 80% and a temperature of about −80° to about 100° C. into a gaseous medium; accelerating said moist tobacco material to a velocity of at least 20 meters per second by means of said gaseous medium, said acceleration reducing the ambient pressure causing said moist tobacco material to expand while in the acceleration zone; decelerating said tobacco material; and drying said tobacco material.

10. The process of claim 9 wherein said tobacco material is introduced into a free jet formed by said gaseous medium.

11. The process of claim 10 wherein said tobacco material is sucked in by the free jet.

12. The process of claim 9 wherein said tobacco material is introduced at the narrowest point of an ejector-type nozzle.

13. The process of claim 9 wherein said tobacco material and said gaseous medium are accelerated in a nozzle of the Venturi type.

14. The process of claim 9 wherein said gaseous material has a temperature of about 50° to about 1000° C.

15. The process of claim 14 wherein said gaseous material has a temperature of at least 100° C.

16. The process of claim 9 wherein said gaseous medium is chosen from the group consisting of air, steam, inert gas, hydrocarbons, or a mixture thereof.

17. The process of claim 1 or claim 9 wherein the tobacco material and the gaseous medium are accelerated together.

18. The process of claim 17 wherein said tobacco material together with said gaseous medium is:

brought to a velocity of about 6 to about 50 meters per second;

accelerated to a velocity of at least 50 meters per second in 1/10 second or less;

conveyed at constant velocity for a time between about 1/100 and 1/1000 of a second; and decelerated.

19. The process of claim 18 wherein the ratio of the velocity of said gaseous medium and said tobacco material before acceleration to the velocity after acceleration is at least 1:3.

20. The process of claim 19 wherein said ratio is at least 1:6.

21. A process for improving the filling capacity of tobacco material by expanding the moist tobacco material in an acceleration zone comprising: introducing said moist tobacco material into a gaseous medium; bringing said tobacco material to a velocity of about 6 to about 50 meters per second by means of said gaseous medium; accelerating said gaseous medium and said tobacco material to a velocity of at least 50 meters per second in 1/10 second or less, said acceleration reducing the ambient pressure causing said moist tobacco material to expand while in the acceleration zone; conveying said gaseous material and said tobacco material at a constant velocity for a time between about 1/100 and 1/1000 of a second; decelerating said tobacco material and said gaseous medium; and drying said tobacco material.

22. The process of claim 21 wherein the ratio of the velocity of said gaseous medium and said tobacco material before acceleration to the velocity after acceleration is at least 1:3.

23. The process of claim 22 wherein said acceleration takes place in a Venturi nozzle.

24. The process of claim 23 wherein said gaseous medium has a temperature between about 50° to about 1000° C.

* * * * *